US010350124B2

(12) United States Patent
Rueth-Gumz

(10) Patent No.: US 10,350,124 B2
(45) Date of Patent: Jul. 16, 2019

(54) PORTABLE URINAL ASSEMBLY

(71) Applicant: Susan Rueth-Gumz, Athens, WI (US)

(72) Inventor: Susan Rueth-Gumz, Athens, WI (US)

( * ) Notice: Subject to any disclaimer, the term of this patent is extended or adjusted under 35 U.S.C. 154(b) by 0 days.

(21) Appl. No.: 15/724,984

(22) Filed: Oct. 4, 2017

(65) Prior Publication Data

US 2019/0099311 A1 Apr. 4, 2019

(51) Int. Cl.
*A61G 9/00* (2006.01)
*A47K 11/12* (2006.01)

(52) U.S. Cl.
CPC ..... *A61G 9/006* (2013.01); *A47K 11/12* (2013.01); *A61G 9/003* (2013.01)

(58) Field of Classification Search
CPC ..... A61G 9/006; A47K 11/12
USPC ..... 4/455
See application file for complete search history.

(56) References Cited

U.S. PATENT DOCUMENTS 190,244 A 5/1877 Olmstead
380,478 A * 4/1888 Duffey ..... 4/455
1,296,713 A * 3/1919 Thieringer ..... A61G 9/003 4/454
2,358,850 A * 9/1944 Chenault ..... A61G 9/006 222/538
3,163,869 A * 1/1965 Johnson ..... A61G 9/006 4/144.1
3,432,863 A 3/1969 Schwartz
D274,469 S * 6/1984 Huang ..... D24/122
5,655,229 A 8/1997 Horn
6,338,166 B1 1/2002 Hereford
D467,338 S 12/2002 Rehrig
7,435,242 B2 10/2008 Levinson
2012/0210503 A1 8/2012 Anzivino, Sr.

* cited by examiner

*Primary Examiner* — Huyen D Le

(57) ABSTRACT

A portable urinal assembly for receiving a scrotum and a penis of an obese person while urinating therein includes a container that has a bottom wall, a top wall and a perimeter wall that is attached to and extends between the top wall and the bottom wall such that a receiving space is formed therein. The receiving space holds urine. The perimeter wall has a front side, a back side, a first lateral side and a second lateral side. The top wall has an opening that extends therethrough. The top wall extends from the front side toward a central area of the top wall. The opening has a perimeter edge that is angled upwardly from the front side to the central area. A conduit is fluidly coupled to container and is in fluid communication with the receiving space. A cap is removably positioned on the conduit to close the conduit.

7 Claims, 3 Drawing Sheets

PORTABLE URINAL ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to bedpan devices and more particularly pertains to a new bedpan device for receiving a scrotum and a penis of an obese person for allowing them to urinate therein.

BRIEF SUMMARY OF THE INVENTION

An embodiment of the disclosure meets the needs presented above by generally comprising a container that has a bottom wall, a top wall and a perimeter wall that is attached to and extends between the top wall and the bottom wall such that a receiving space is formed therein. The receiving space is configured to hold urine. The perimeter wall has a front side, a back side, a first lateral side and a second lateral side. The top wall has an opening that extends therethrough. The top wall extends from the front side toward a central area of the top wall. The opening has a perimeter edge that is angled upwardly from the front side to the central area. A conduit is fluidly coupled to container and is in fluid communication with the receiving space. A cap is removably positioned on the conduit to close the conduit.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
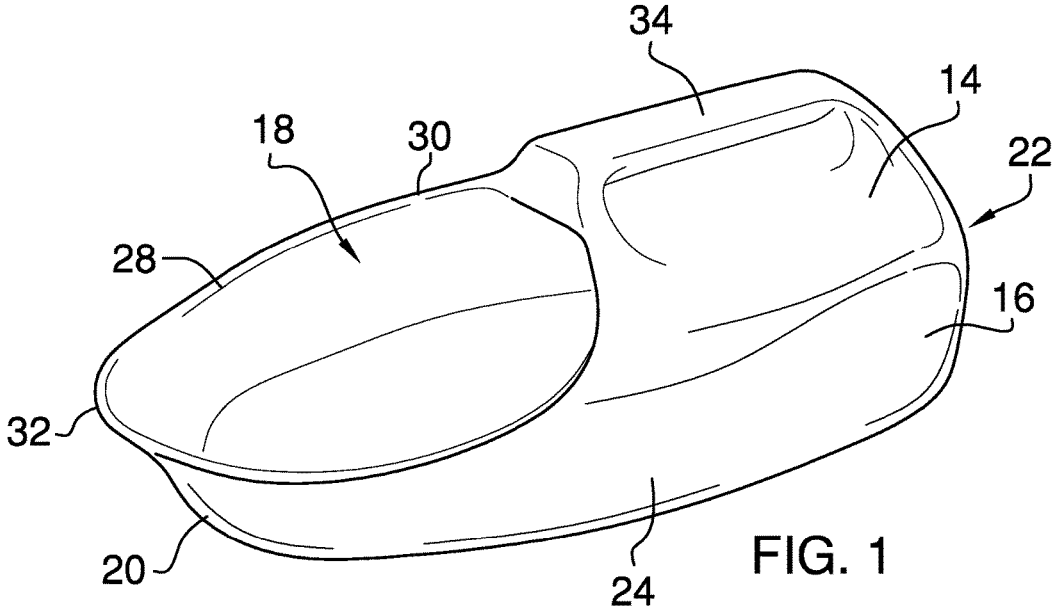
FIG. 1 is a top perspective view of a portable urinal assembly according to an embodiment of the disclosure.
Figure 2:
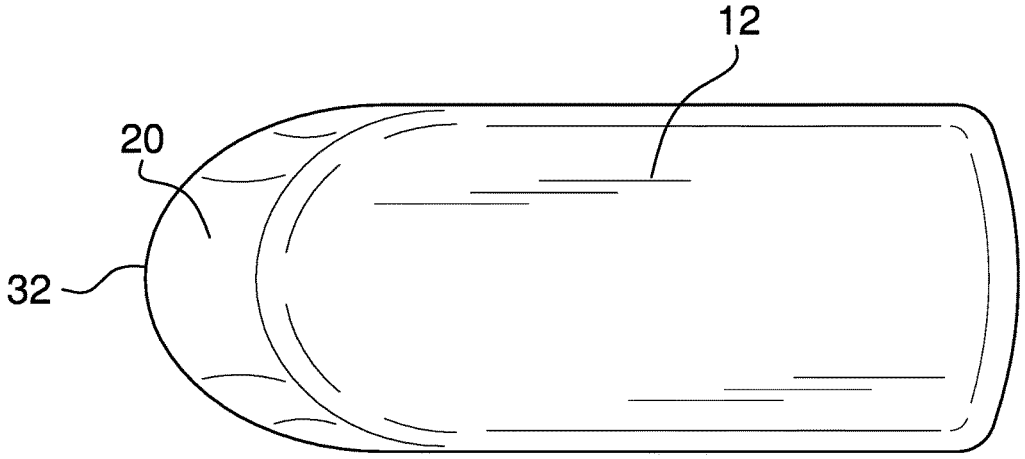
FIG. 2 is a bottom view of an embodiment of the disclosure.
Figure 3:
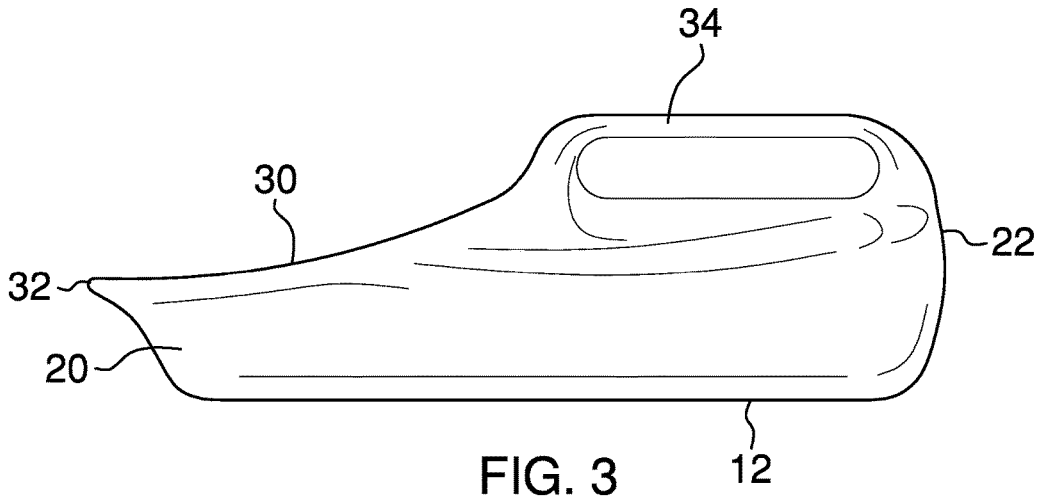
FIG. 3 is a side view of an embodiment of the disclosure.
Figure 4:
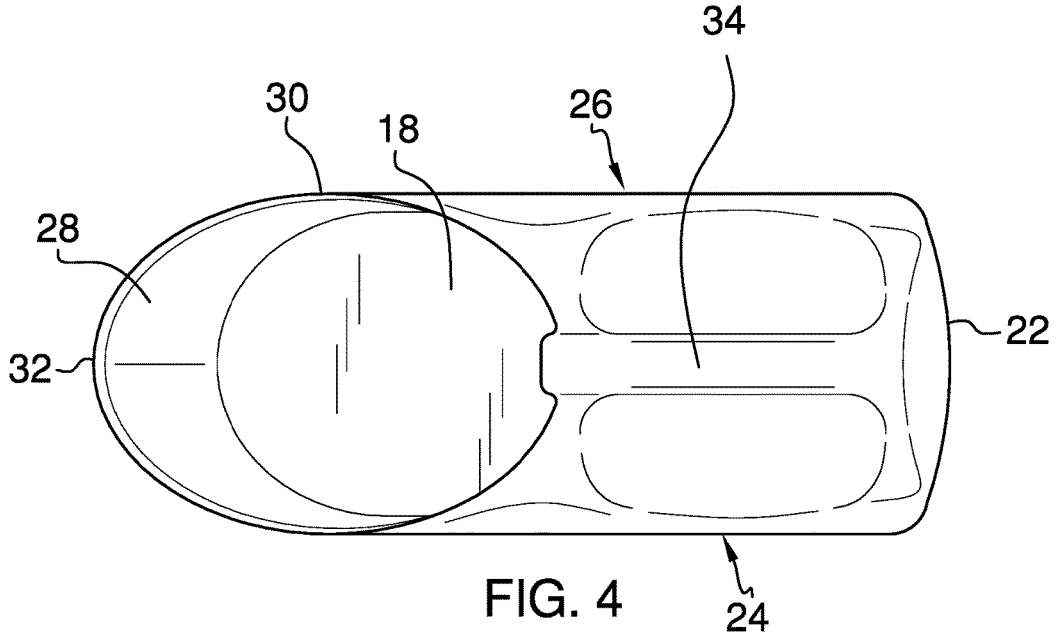
FIG. 4 is a top view of an embodiment of the disclosure.
Figure 5:
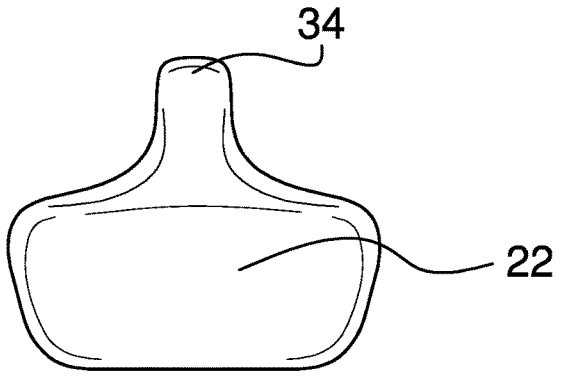
FIG. 5 is a back view of an embodiment of the disclosure.
Figure 6:
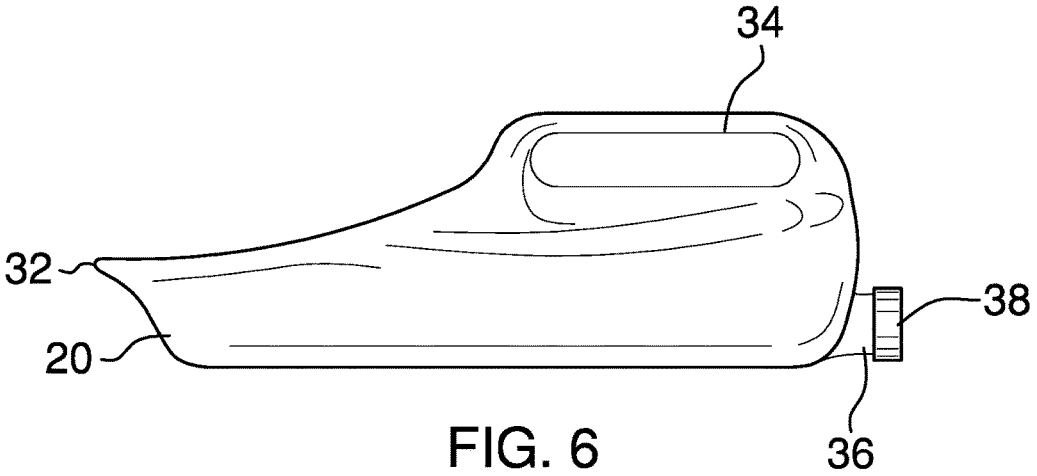
FIG. 6 is a side view of an embodiment of the disclosure.

With reference now to the drawings, and in particular to FIGS. 1 through 6 thereof, a new bedpan device embodying the principles and concepts of an embodiment of the disclosure and generally designated by the reference numeral 10 will be described.

As best illustrated in FIGS. 1 through 6, the portable urinal assembly 10 generally comprises a container that has a bottom wall 12, a top wall 14 and a perimeter wall 16 that is attached to and extends between the top wall 14 and the bottom wall 12 such that a receiving space 18 is formed therein. The receiving space 18 holds urine. The container has a length that is between 8.0 inches and 15.0 inches and a width that is between 6.0 inches and 10.0 inches. The perimeter wall 16 has a height between 3.0 inches and 8.0 inches. The perimeter wall 16 has a front side 20, a back side 22, a first lateral side 24 and a second lateral side 26. The top wall 14 has an opening 28 that extends therethrough. The opening 28 extends from the front side toward a central area of the top wall 14. The opening 28 has a perimeter edge 30. The perimeter edge 30 angles upwardly from the front side 20 to the central area. The front side 20 angles forward as the front side 20 extends upwardly from the bottom wall 12 to the top wall 14 to define a lip 32. The lip 32 is positionable between the scrotum and a perineum wherein the scrotum and the penis may rest in the receiving space 18. The container may be comprised of a plastic material.

A handle 34 is attached to and extends upwardly from the top wall 14. The handle 34 is positioned nearer to the back side 22 than the front side 20. A conduit 36 is fluidly coupled to container and is in fluid communication with the receiving space 18 and may be positioned on the back side 22 and adjacent to the bottom wall 12. A cap 38 is removably positioned on the conduit 36 to close the conduit 36. The cap 38 may be secured in a conventional manner and in particular the cap 38 may be threadably coupled to the conduit 36.

In use, the lip 32 is placed under the scrotum such that the scrotum and penis of a person are positioned within the receiving space 18 and the lip 32 is between the scrotum and the perineum. Then person then urinates into the assembly 10 wherein the receiving space 18 holds the urine. The handle 34 is used to hold the assembly 10 in position while urinating therein and thereafter carry the assembly 10 such that the urine is not displaced from the receiving space 18. To empty the assembly 10, the assembly 10 is positioned over a toilet and the cap 38 is removed to open the conduit 36 such that the urine is released from the receiving space 18 and outwardly toward the toilet.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A portable urinal assembly configured to receive a scrotum and a penis of an obese person while urinating therein, said assembly comprising:

a container having a bottom wall, a top wall and a perimeter wall being attached to and extending between said top wall and said bottom wall such that a receiving space is formed therein, said receiving space being configured to hold urine, said perimeter wall having a front side, a back side, a first lateral side and a second lateral side, said top wall having an opening extending therethrough, said opening extending from said front side toward a central area of said top wall, said opening having a perimeter edge, said perimeter edge being angled upwardly from said front side to said central area, said opening being elliptical-shaped, a minor axis of said opening being oriented perpendicular to a longitudinal axis of said container, a length of said minor axis of said opening being equal to a width of said container;

a conduit being fluidly coupled to container and being in fluid communication with said receiving space; and a cap being removably positioned on said conduit to close said conduit.

2. The portable urinal assembly according to claim 1, wherein said front side is angled forward as said front side extends upwardly from said bottom wall to said top wall to define a lip, said lip being configured to be positioned between said scrotum and a perineum wherein said scrotum and said penis may rest in said receiving space.

3. The portable urinal assembly according to claim 1, wherein said container is comprised of a plastic material.

4. The portable urinal assembly according to claim 1, further including a handle being attached to and extending upwardly from said top wall.

5. The portable urinal assembly according to claim 4, wherein said handle is positioned nearer to said back side than said front side.

6. The portable urinal assembly according to claim 1, wherein said conduit is positioned adjacent to said bottom wall and on said back side.

7. A portable urinal assembly configured to receive a scrotum and a penis of an obese person while urinating therein, said assembly comprising:

a container having a bottom wall, a top wall and a perimeter wall being attached to and extending between said top wall and said bottom wall such that a receiving space is formed therein, said receiving space being configured to hold urine, said perimeter wall having a front side, a back side, a first lateral side and a second lateral side, said top wall having an opening extending therethrough, said opening extending from said front side toward a central area of said top wall, said opening having a perimeter edge, said perimeter edge being angled upwardly from said front side to said central area, said opening being elliptical-shaped, a minor axis of said opening being oriented perpendicular to a longitudinal axis of said container, a length of said minor axis of said opening being equal to a width of said container, said front side being angled forward as said front side extends upwardly from said bottom wall to said top wall to define a lip, said lip being configured to be positioned between said scrotum and a perineum wherein said scrotum and said penis may rest in said receiving space, said container being comprised of a plastic material;

a handle being attached to and extending upwardly from said top wall, said handle being positioned nearer to said back side than said front side;

a conduit being fluidly coupled to container and being in fluid communication with said receiving space, said conduit being positioned on said back side and adjacent to said bottom wall; and a cap being removably positioned on said conduit to close said conduit, said cap being threadably coupled to said conduit.

* * * * *